United States Patent [19]

Sloan et al.

[11] 4,136,863

[45] Jan. 30, 1979

[54] SYSTEM FOR STACKING FLEXIBLE OR SEMI-RIGID ARTICLES

[75] Inventors: Donald A. Sloan; James F. King, both of Winston-Salem, N.C.

[73] Assignee: Hanes Corporation, Winston-Salem, N.C.

[21] Appl. No.: 849,103

[22] Filed: Nov. 7, 1977

[51] Int. Cl.[2] ..... B65H 31/08

[52] U.S. Cl. ..... 271/212; 271/216

[58] Field of Search ..... 271/212, 213–219, 271/1; 214/6 BA

[56] References Cited

U.S. PATENT DOCUMENTS

| | | | |
|---|---|---|---|
| 1,019,059 | 3/1912 | Lewis | 271/216 |
| 2,683,601 | 7/1954 | Camerano | 271/216 |
| 2,723,851 | 11/1955 | Camerano | 271/216 |

*Primary Examiner*—Richard A. Schacher
*Attorney, Agent, or Firm*—Charles Y. Lackey; William S. Burden

[57] ABSTRACT

A system for receiving semi-rigid or flexible workpieces from a prior operation, and stacking the workpieces in a specified, stable fashion for employment in a subsequent operation. A conveyer advances sequentially random spaced workpieces to the bottom of a vertical stack which is driven in a circular path upon a support plate by a rotor assembly. A ramp or scoop of the support plate extends generally radially from the axis of rotation of the rotor assembly and directs workpieces from the conveyor to the top of the support plate and beneath the workpieces already positioned within the stack.

19 Claims, 16 Drawing Figures

SYSTEM FOR STACKING FLEXIBLE OR SEMI-RIGID ARTICLES

BRIEF SUMMARY AND OBJECTS OF THE INVENTION

This invention relates generally to the stacking of various articles or workpieces of flexible or semi-rigid materials, and more particularly to a new and improved system for handling materials, such as fabric, which is conveyed and readily stacked in an orderly fashion for use in subsequent work operations.

While the invention will be described with respect to the handling of articles such as T-shirt sleeves which are received from automatic sleeve-making equipment and stacked for use by sewing machine operators when setting the T-shirt sleeves into the body of the garment, it will be understood that the system can be utilized equally well when stacking other articles including fabric pockets, various garment components, workpieces, and other semi-rigid materials such as plastic, leather, paper products, etc., of various sizes and configurations.

Briefly, the material handling system of the present invention receives sleeves or other fabric parts from an automatic garment-making operation and stacks or assembles the sleeves in a compact package arrangement for subsequent use by sewing machine operators.

The sleeves are deposited sequentially upon a conveyor arrangement in random fashion and advanced to a station where they are combined in random fashion to form a vertical stack in a generally round pattern. The sleeves are advanced to a position below the bottom of the stack and fed through an opening within a plate which supports the sleeves forming the stack. A driven, vertically displaceable rotor assembly is located above the plate for engaging the uppermost sleeves forming the stack and rotating the entire stack about a vertical axis. When initially forming the stack, the sleeves move through the opening in the support plate and come into engagement with the rotor assembly which pulls the sleeves from the conveyor and directs them in a circular path between the plate and the rotor. The resulting random stack is essentially self-leveling and relatively firm or solid with the sleeves maintaining their orientation, permitting the stack to be handled, stored, or transported easily and conveniently.

One of the primary objects of the invention is the provision of a new and improved system for vertically stacking articles by directing the articles to the bottom of a rotating stack.

Another object of the invention is the provision of a bottom loading apparatus for stacking fabric or other semi-rigid articles which is simple, reliable, and efficient in operation.

Still another object of the invention is the provision of a system for random stacking articles, resulting in a stable, generally round, essentially self-leveling package.

A further object of the invention is the provision of a high-speed stacking system which results in articles being collected in a convenient fashion for storage or for transport and use in a subsequent operation.

Other objects and advantages of the invention will become apparent when considered in view of the following detailed description.

DETAILED DESCRIPTION OF THE INVENTION

Figure 1:
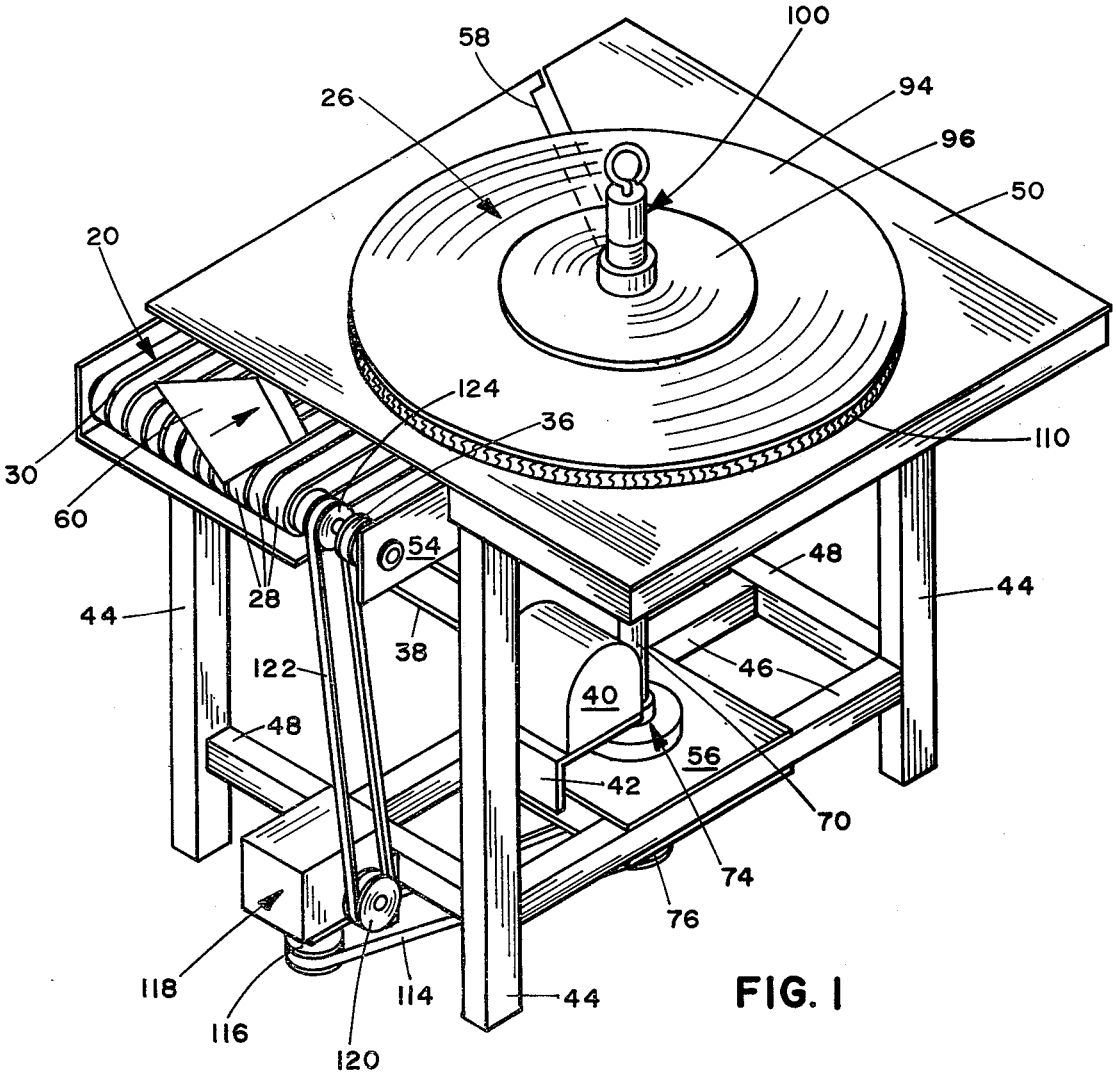
FIG. 1 is a front perspective view of the apparatus of the present invention.
Figure 2:
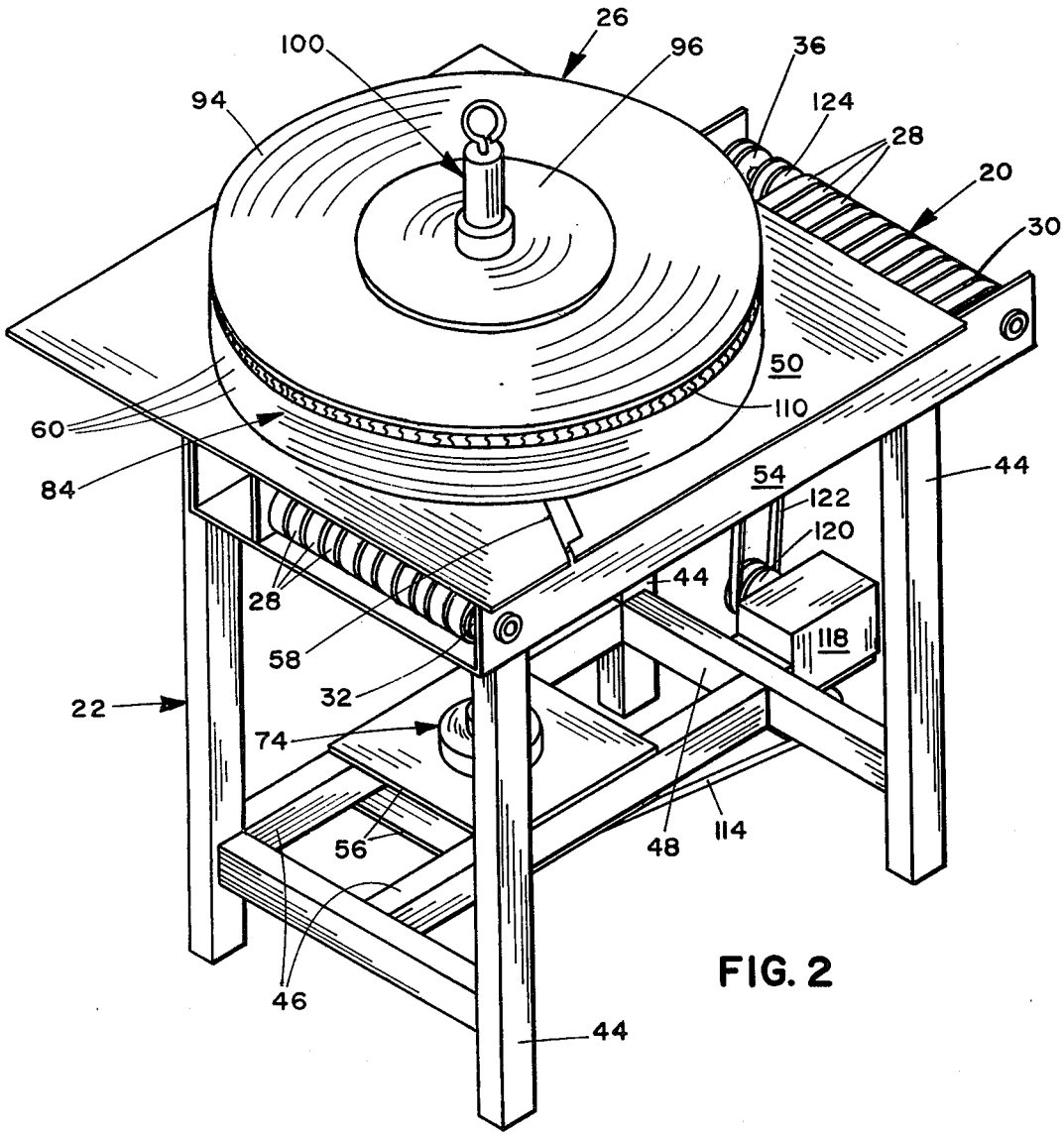
FIG. 2 is a side perspective view of the apparatus illustrating the rotor assembly in an elevated position.

Referring to the drawing, and particularly to FIGS. 1–4, the apparatus of the present invention includes a conveyor assembly 20 for advancing sequentially a plurality of workpieces, hereafter referred to as sleeves, a support structure 22, a spindle assembly 24, and a rotor assembly 26.

The conveyor assembly 20 includes a plurality of laterally spaced, endless, conveyor belts 28 supported upon spaced rollers 30, 32. The rollers are supported at their ends by laterally spaced frame members of the support structure 22. The roller 30 is driven, through pulleys 34, 36 and belt 38, from a motor 40 to feed the sleeves in the direction of the arrow, FIGS. 1 and 4. The motor 40 may be supported upon a bracket 42 attached to support structure 22, and the pulley 36 is secured to a shaft extending from roller 30. The conveyor belts 28 may be of a conventional type or may be a series of elastic bands. When elastic bands are utilized, grooves are provided in the rollers for each band, and O-rings are positioned in the grooves to provide a crown for each belt to maintain proper tracking or alignment of the bands. Alternatively, a single belt of the desired width could be utilized for feeding the sleeves.

The support structure 22 includes vertical frame members 44, interconnected by pairs of horizontally disposed frame members 46 and 48, and a large rectangular or square support plate 50 secured to the upper ends of the vertical members 44. The plate 50 is provided with an aperture 52 of a size sufficiently large to receive a portion of the spindle assembly 24 therethrough, as will be subsequently described. The shafts of conveyor belt rollers 30 and 32 preferably are supported by frame members 54 and 44. A pair of vertically spaced plates 56 are secured to and interconnect horizontally disposed frame members 46, 46 and serve as a support for the spindle assembly 24, FIGS. 2 and 5.

The support plate 50 has an upper surface sufficiently smooth to permit the stack of sleeves to be displaced thereon in a generally circular pattern, and preferably is of stainless steel construction. The plate 50 is in close proximity to and generally parallel relation with the upper runs of the elastic bands 28 but spaced sufficiently above the bands to permit the sleeves to move underneath. Further, the plate 50 must be sufficiently large to completely cover the width of the elastic bands 28 forming the conveyor.

Figure 4:
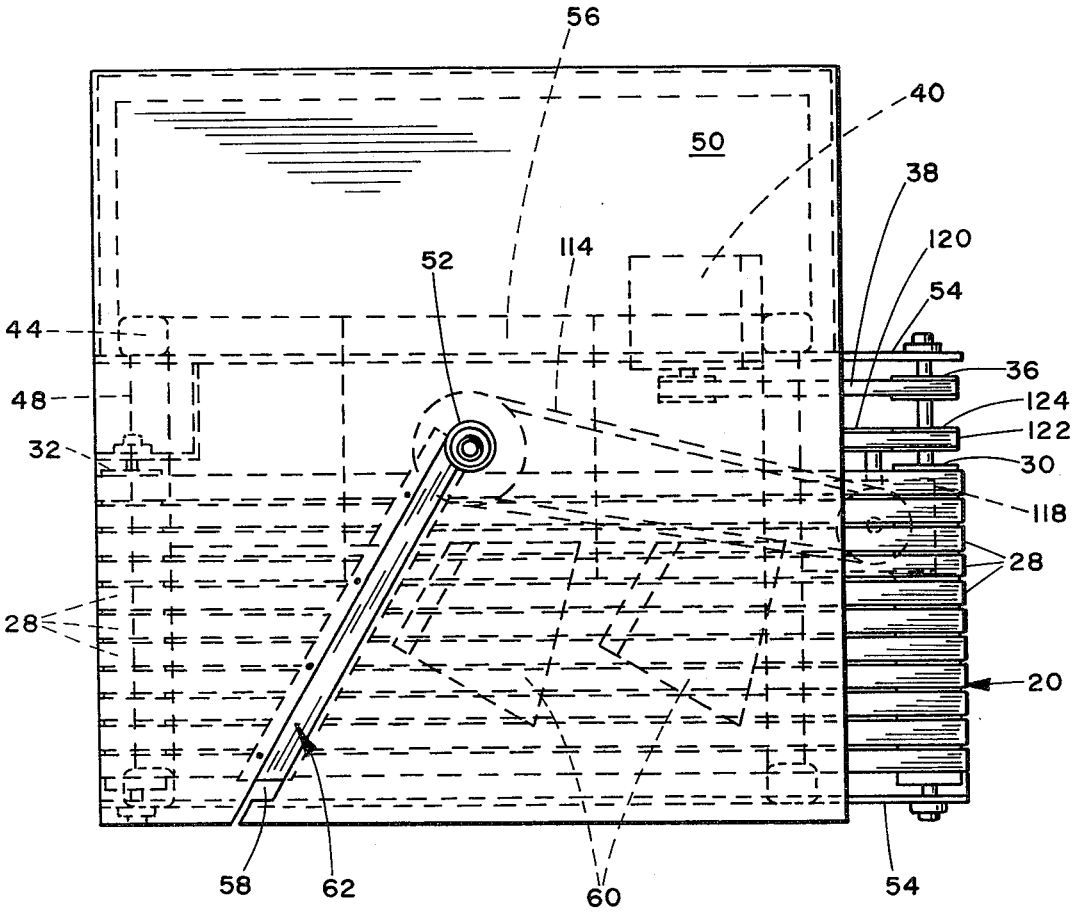
FIG. 4 is a top plan view of the apparatus of FIGS. 1 and 2 with the rotor assembly removed.

In addition to the aperture 52, the plate 50 is provided with a slot or elongated opening 58 which extends outwardly from the aperture 52 a prescribed distance, and preferably has a length extending to the outermost elastic band 28 such that the slot extends completely across all elastic bands 28. In the embodiment illustrated, the slot 58 does not extend perpendicular to the path of travel of the upper run of the conveyor but preferably extends at an angle of approximately 30° with respect to the path of travel, as shown by FIG. 4, when stacking sleeves of the configuration illustrated. This reduces the swinging effect of the sleeve 60 as it is directed from the linear path of conveyor 20 to the rotary path of rotor assembly 26. However, the particular angular relationship of the slot with respect to the path of travel of the elastic conveyor bands may vary, depending upon the particular configuration, types of material, etc., of the articles or sleeves to be stacked.

Figure 14:
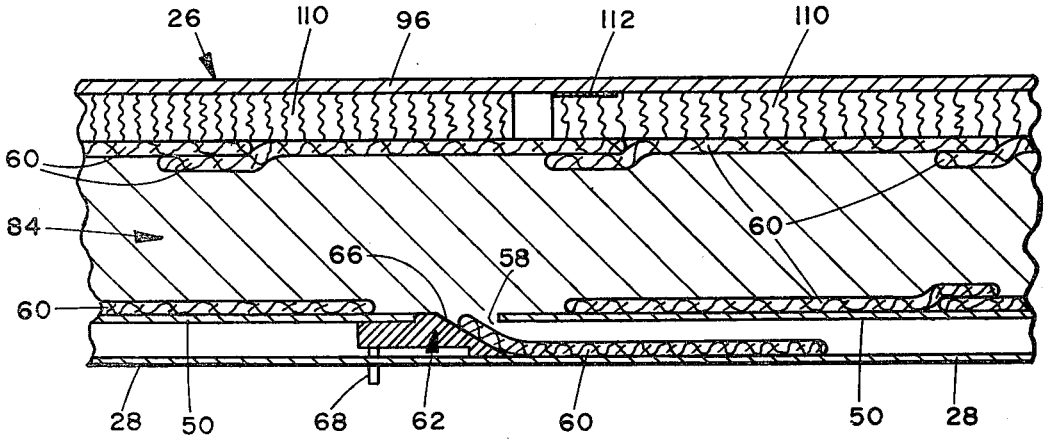
FIG. 14 is an enlarged, cross-sectional view of the support plate and scoop illustrating the manner in which the sleeves are fed from the feed belts to the upper surface of the support plate beneath the rotor assembly.
Figure 11:
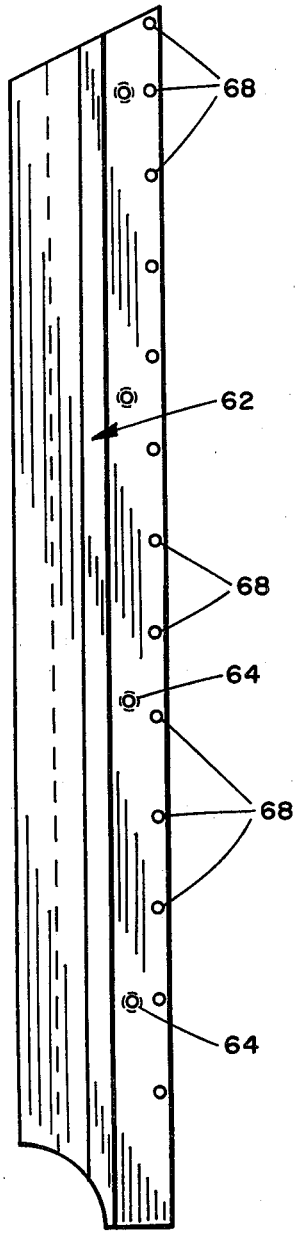
FIG. 11 is an enlarged, top plan view of the ramp or scoop located within the slot of the support plate.

A deflector member 62 is attached by fasteners 64, FIG. 11, to the plate 50 adjacent slot 58 and includes a ramp or incline section 66 positioned within the slot 58 to effect upward movement of the sleeves 60 from the conveyor belts 28 to the upper surface of support plate 50, note FIG. 14. The deflector member also is provided with a series of laterally spaced pins 68 which extend downwardly between the conveyor belts 28 for guiding and maintaining the spaced relation of the upper runs of the conveyor belts. At least the ramp 66 of the deflector 62 has a smooth or polished surface, and preferably is of chrome plated construction, to facilitate ease of movement of the sleeves 60 to the plate 50. Rather than providing a separate deflector member 62, it may be desirable to angle downwardly an edge of the support plate defining the slot which would serve as a ramp for guiding the sleeves to the rotary assembly.

Figure 5:
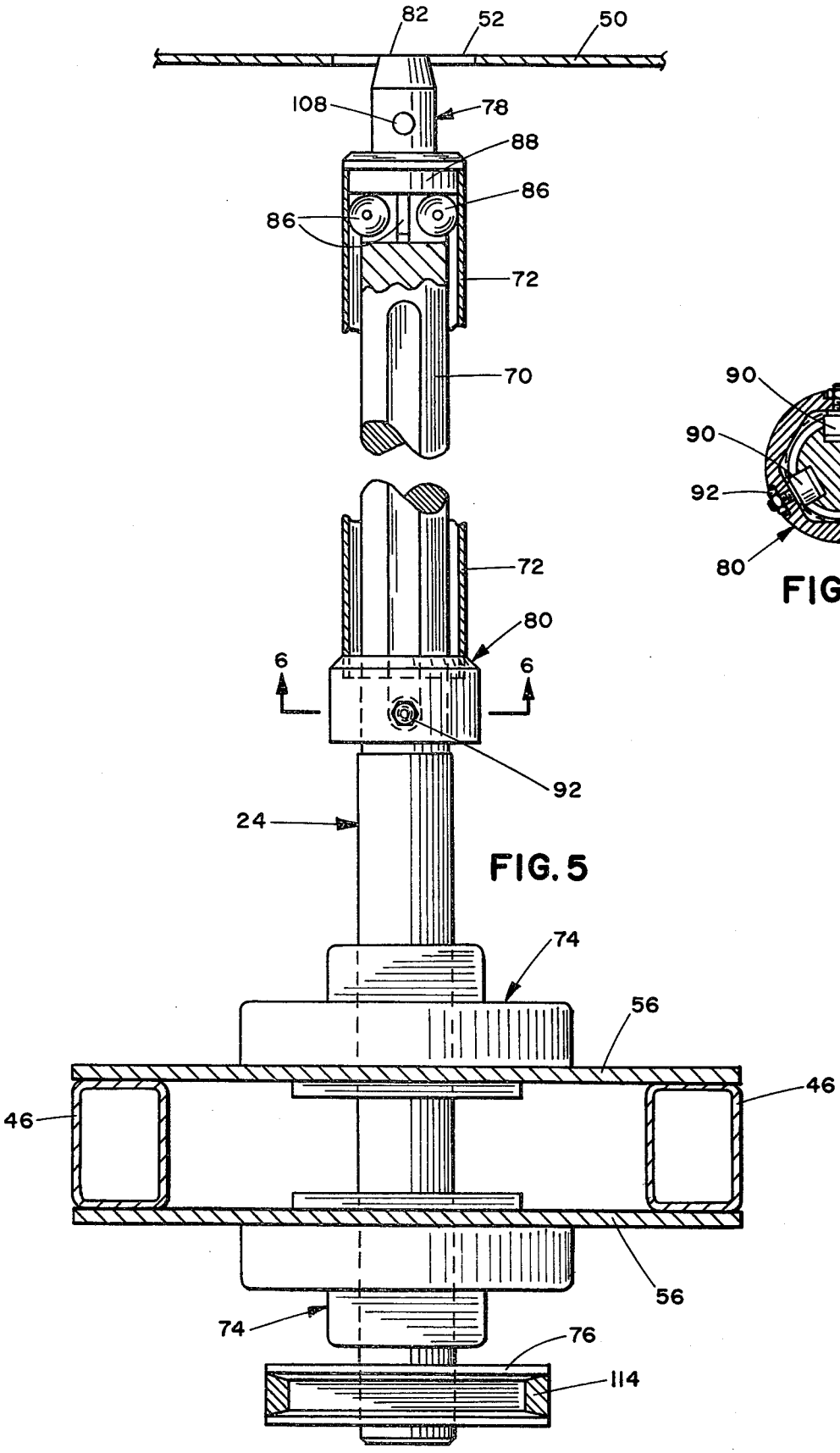
FIG. 5 is an enlarged, fragmentary, elevational view of the apparatus illustrating the spindle assembly and mounting mechanisms therefor.
Figure 6:
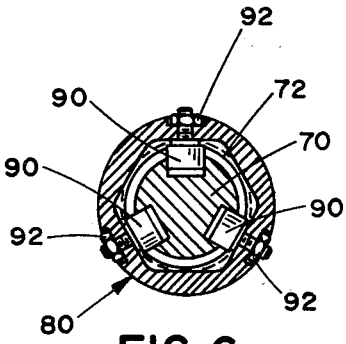
FIG. 6 is a sectional view taken along line 6—6 of FIG. 5.

The spindle assembly 24 includes a vertically disposed shaft 70, FIGS. 5 and 6, slidably supporting thereon a sleeve or tube 72. The shaft 70 is rotatably mounted within bearing units 74 which, in turn, are secured to plates 56 and the frame members 46. The shaft is driven from a pulley 76, as will be subsequently described.

Figure 3:
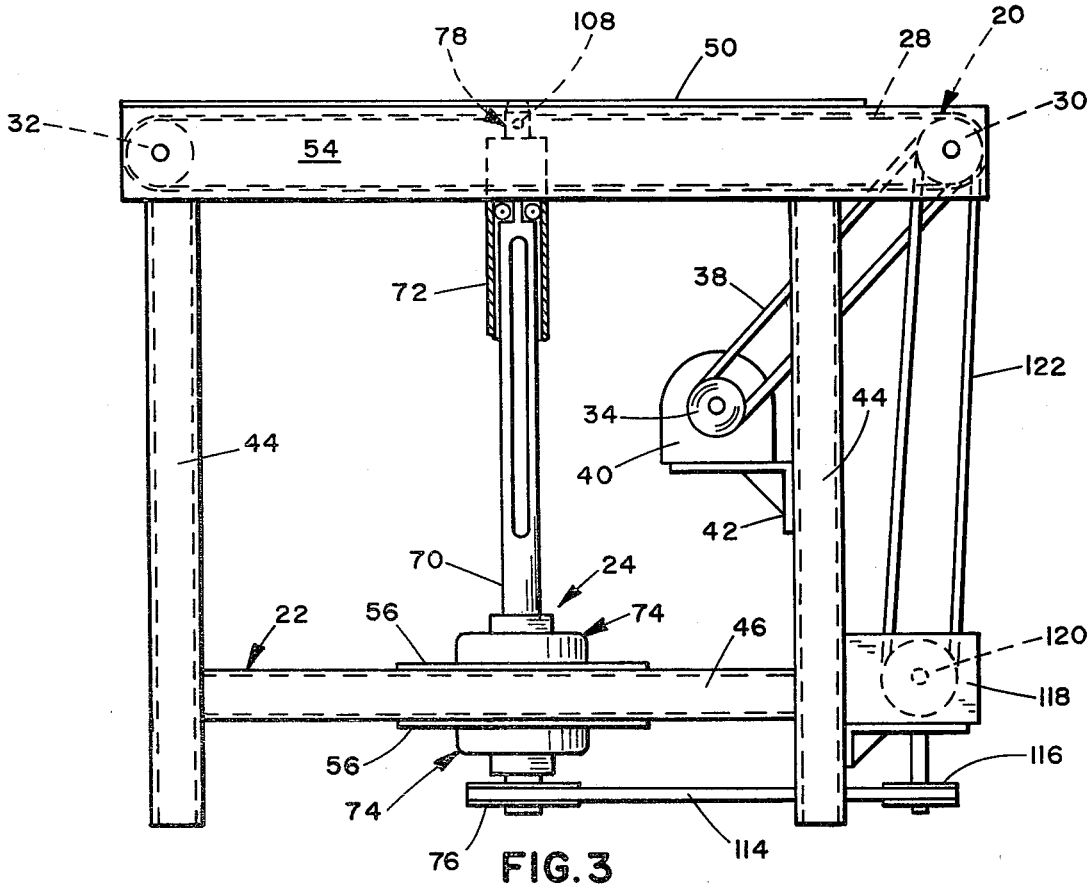
FIG. 3 is a side elevational view of the apparatus of FIGS. 1 and 2 with the rotor assembly removed.

The tube 72 is provided with a coupling unit 78 at the upper end, for attachment to the rotor assembly 26, and a collar assembly 80 attached to the lower end thereof. The tube 72 initially is positioned, as shown by FIGS. 3 and 5 with the upper edge 82 of the coupling unit 78 located flush with or below the upper surface of support plate 50, and slides vertically upwardly upon the shaft 70 as the garment sleeves 60 build up forming the stack 84, illustrated by FIG. 2. A plurality of rollers 86 are provided at the upper end portion of shaft 70 for ease of movement and to prevent binding of the tube 72 upon the shaft. A resilient element 88 also is attached to the upper end of shaft 70 and serves as a bumper when the tube 72 slides downwardly upon the shaft after being disconnected from the rotor assembly.

The collar assembly 80 receives the lower end of tube 72 and is provided with a plurality of bearing elements 90 which extend through openings in the tube and engage the splines of shaft 70 to transmit shaft rotation to the tube 72, and to serve as bearings or guides for the lower end of the tube when displaced upon the shaft 70. The bearing elements 90 are secured to the collar assembly 80 by releasable fasteners 92.

Figure 7:
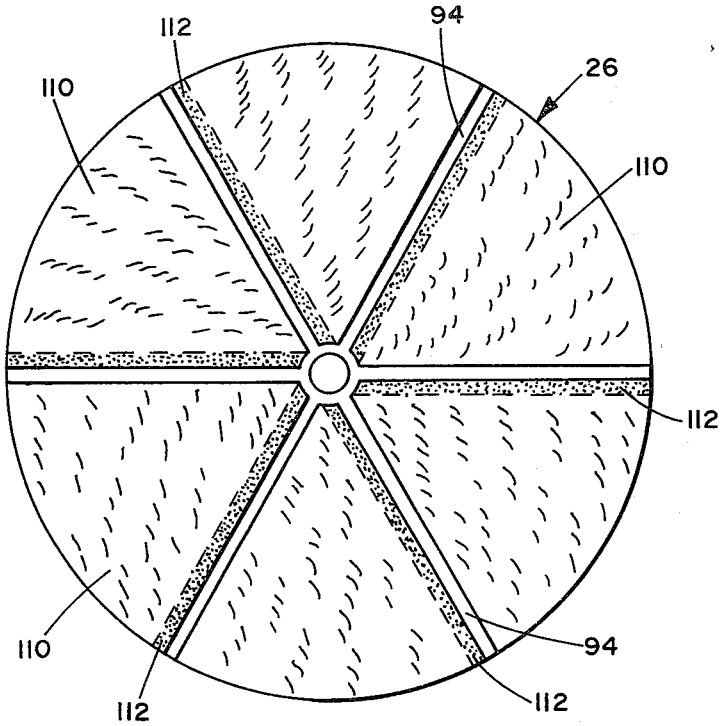
FIG. 7 is a bottom plan view of one embodiment of the rotor assembly illustrating frictional material secured thereto.
Figure 8:
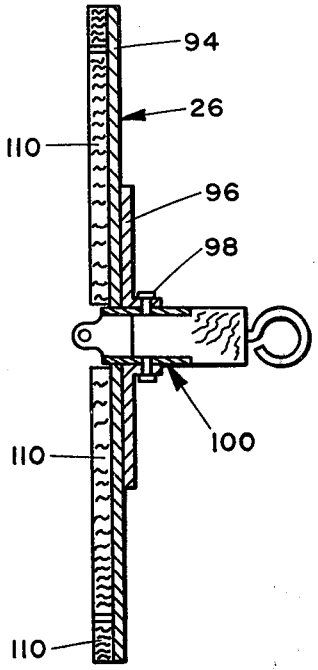
FIG. 8 is a side elevational view of the rotor assembly of FIG. 7.
Figure 9:
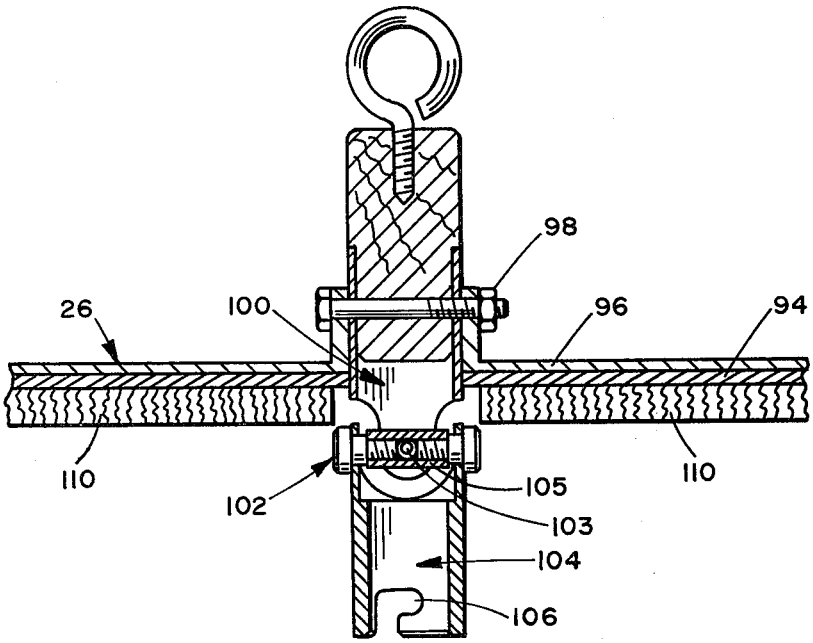
FIG. 9 is an enlarged sectional view of the rotor assembly illustrating the universal joint and the coupling element for releasably securing the rotor to the spindle assembly.
Figure 10:
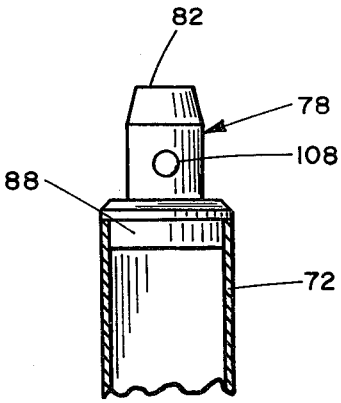
FIG. 10 is a fragmentary elevational view of the outer end of the spindle assembly illustrating the pin for releasably coupling the spindle assembly and the rotor assembly.
Figure 12:
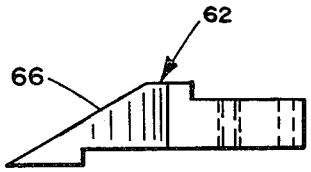
FIG. 12 is a side elevational view of the scoop of FIG. 11.
Figure 13:
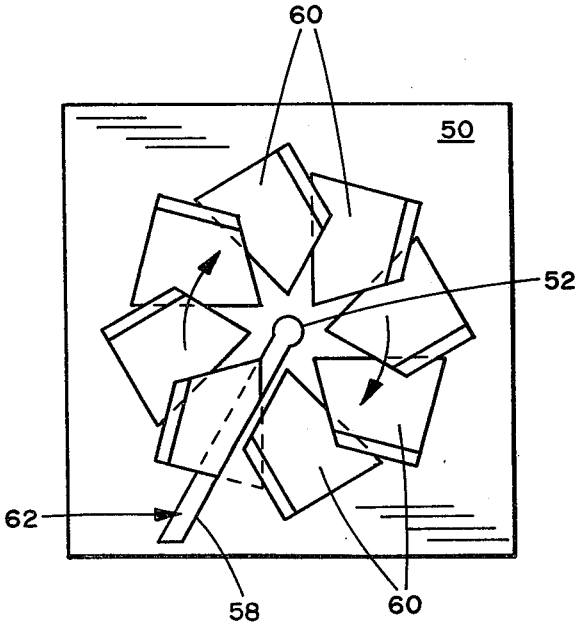
FIG. 13 is a top plan view of the support plate illustrating positioning of an initial group of fabric sleeves thereon.

Referring to FIGS. 7–9, the rotor assembly 26 comprises a disk or a rotor 94 attached to a backing plate 96, which is connected by a fastener 98 to the upper section 100 of a universal joint 102 having pivot pins 103 and 105. The lower section 104 of the universal joint is provided with a socket 106 for releasably receiving the pin 108 of the tube coupling unit 78.

The lower side of the rotor 94 preferably is provided with a friction surface for engaging and pulling the sleeves 60 as they extend through the slot 58 as the rotor circulates about the plate 50. The friction surface may be napped material, foam rubber, carpet material, etc., and may completely cover the rotor or may be in a plurality of spaced segments, as desired.

In the embodiment illustrated, the rotor 94 is provided with six segments of carpet 110, each segment being generally pie-shaped. In the direction of rotation of the rotor 94, the leading edge 112 of each segment 110 is secured to the rotor with adhesive, or other suitable means. Securing the segments in this manner permits deflection or displacement of the various segments 110 relative to each other, and also displacement of various sections of the same segment to compensate for irregularities in the configuration of the stack 84 as it increases in size.

As previously indicated, the rotor 26 receives its drive from shaft 70 and pulley 76. The pulley 76 is driven indirectly from motor 40 by means of the belt 114, pulley 116 secured to the shaft of a right angle gearbox 118, a pulley 120 also secured to the gearbox 118 and a belt 122 which travels over pulley 124 secured to rotate with the conveyor roller 30 and pulley 36.

The speeds of the conveyor and rotor must be synchronized, through the various pulleys and gearbox, with the rotor speed being greater than the belt speed, such that once a sleeve 60 contacts the rotor or other sleeve being driven in a circular path by the rotor, the sleeve is pulled away from the conveyor. For example, the belt speed of the conveyor may be approximately 40 feet per minute and the belt advances approximately 1.8 feet per revolution of the rotor 94, the rotor being approximately 2 feet in diameter.

Figure 15:
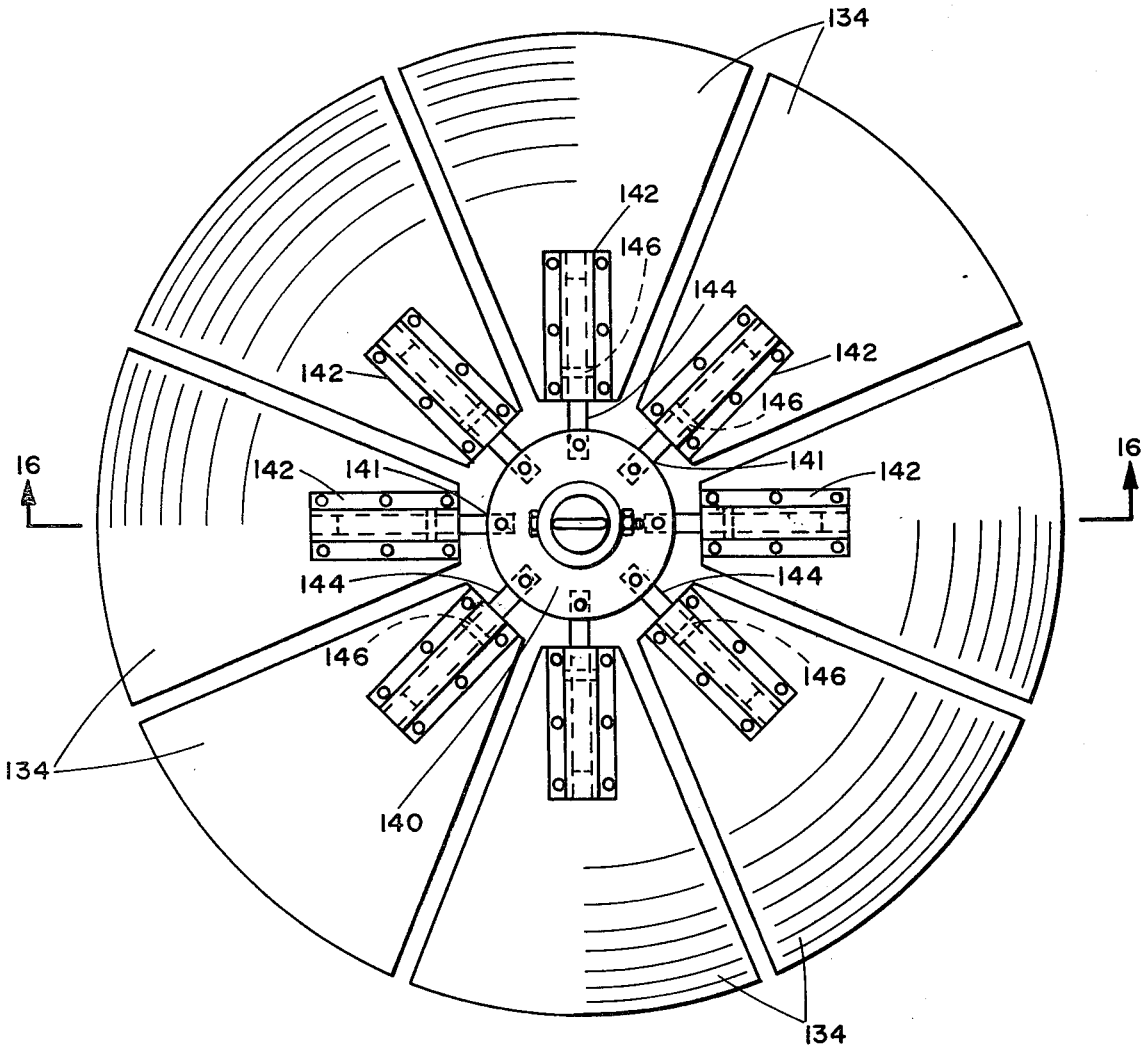
FIG. 15 is a top plan view of a modified embodiment of a rotor assembly wherein the rotor includes a plurality of segments capable of displacement relative to each other.
Figure 16:
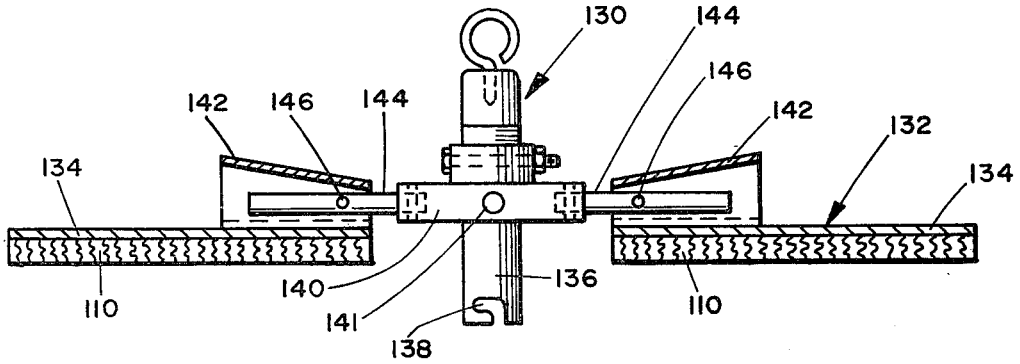
FIG. 16 is a cross-sectional view, taken along line 16—16, of the apparatus of FIG. 15.

FIGS. 15 and 16 illustrate a modified embodiment of the rotor assembly, wherein the rotor 130 consists of a segmented disk 132 having a plurality of generally pie-shaped segments 134. Although eight segments have been illustrated, the number, size and configuration of the segments may vary. The segments are capable of pivotable movement relative to each other such that they may undulate and engage substantially the entire upper surface of a stack of sleeves which may be unlevel having high and low portions. The rotor assembly may comprise a rigid sleeve member 136 having a socket 138 for releasable coupling with a pin 108 of the spindle assembly, as shown by FIGS. 15 and 16 or, alternatively, the rotor assembly may include a universal joint coupling, as illustrated in FIG. 9, in addition to the pivoted rotor segments.

Secured to the sleeve member 136 is a collar 140 having a series of radiating openings 141, one for each disc segment. An inverted, generally U-shaped drive bracket 142 is attached to each segment 134 forming a tunnel, and an elongated bar or rod 144, extending into the tunnel, is pivotably secured thereto by a pin 146. The rods 144 extend through the openings 141 in collar 140 and are rigidly secured, by suitable means, to the collar. Each rod 144 cooperates with a bracket 142 and a disc segment 134 to limit the degree of movement of the segment. The segments 134 may flex approximately 10 degrees up or down. Carpet or other friction material preferably is provided on the underneath surface of each segment 134 with the material being secured over the entire segment area, or only in designated areas, as previously disclosed and as illustrated by FIGS. 7 and 8.

The operation of the apparatus will now be described. Actuation of motor 40 drives both the conveyor assembly 20 and the rotor assembly 26. The sleeves 60 which are randomly deposited upon the conveyor belts 28 from a prior sleeve-making operation are advanced along a path at a prescribed rate of speed beneath the support plate 50. As illustrated in the drawing, the hemmed edges of the sleeves, which are thicker than the remainder of the sleeve portions, are the leading edges in the direction of yarn travel, and are generally parallel to the slot 58 and support plate 50.

Initially, the tube 72 of the spindle assembly is at its lowermost position, as shown by FIG. 5, with the upper end thereof flush with the upper surface of plate 50. The rotor assembly 26 is coupled to the tube 72 for rotation therewith by pin 108 and socket 106. The carpet material 110 of the rotor assembly rests upon the plate 50 and is adapted to receive therebeneath sleeves 60 as they are advanced by the conveyor. As each sleeve approaches the slot 58, it is directed upwardly through the slot by the ramp 66 and towards the upper surface of plate 50. As a sleeve moves through the slot, carpet material of the rotor engages the sleeve, pulling it from the conveyor. Since the sleeve is clamped or pressed between the plate 50 and the carpet 110, due to the weight of the rotor assembly, the sleeve 60 is advanced in a circular path under the rotor and upon the upper polished surface of the plate 50. As additional sleeves are fed by the conveyer, they build up in a shingled or overlapping relationship below the rotor carpet 110. The overlapping and interlocking relationship of the sleeves provides mutual support to the sleeves resulting in a solid, stable stack. As the stack increases in height, it is essentially self-leveling. However, since the sleeves are advanced in random by the conveyor belts 28, and since the sleeves are of uneven thickness, the upper surface of the stack 60 may be slightly uneven defining high and low portions. However, with the uneven stack, the carpet segments 110 are maintained in contact with substantially the entire upper surface of the stack due to the manner in which only the leading edges of the carpet segments 110 are attached to the rotor 94, and due to the fact that the universal joint coupling 102 permits tilting of the rotor 94 relative to the tube 72.

As sleeves 60 build up under the rotor 94, the rotor is urged upwardly advancing vertically the tube 72 which is connected by splines to the driven shaft 70. The completed stack 60 may, for example, consist of 45–55 dozen T-shirt sleeves having a height of 8–12 inches. The radius of the stack would depend upon the particular size of the sleeves being stacked, and the minimum radius would be equal to the radius of the tube 72 plus the longest sleeve dimension perpendicular to the path of travel of the conveyor belts.

After stacking the sleeves to the desired height, the motor 40 is stopped, and the rotor assembly rotated sufficiently in the direction of the normal rotation to disconnect the pin 108 from socket 106. This permits the tube 72 to automatically slide downwardly on shaft 70 to a position below the upper surface of plate 50. The rotor assembly is removed, facilitated by a handle or hook, from the top of the stack 84. Due to the stability of the completed stack, the orientation of the sleeves is maintained and it is possible to slide the entire stack from the support plate 50 directly onto a tray or other support for storage or transport to a subsequent operation where an operator sews the sleeves to the body portions of the garments.

What is claimed is:

1. The method of assembling a plurality of flexible or semi-rigid articles in vertically aligned condition comprising the steps of: advancing an article along a first linear path, elevating the article from the first path to a second path, rotating the article in the second path about a vertical axis, advancing a second article along the first path, elevating the second article from the first path to the second path and rotating the second article in the second path about the vertical axis, and repeating the steps with additional articles where subsequent articles are sequentially elevated from the first path to the second path and positioned beneath articles previously positioned within and rotating in the second path to stack the articles vertically.

2. The method of assembling a plurality of flexible or semi-rigid articles as recited in claim 1, wherein the articles within the second path are continuously rotated about the vertical axis and the articles advanced along the first linear path are randomly spaced.

3. The method of assembling a plurality of articles into a generally cylindrical, vertical stack upon a support surface comprising the steps of: feeding sequentially a plurality of articles along a first path below the support surface, sequentially directing the articles upwardly to the support surface, and continuously advancing the articles in a circular path upon the support surface to arrange the articles in random, overlapping relation forming a vertical, generally rounded stack.

4. The method of assembling a plurality of articles as recited in claim 3, wherein the articles in the circular path are advanced at a greater rate of speed than the articles being fed along the first path.

5. The method of assembling a plurality of articles as recited in claim 3, wherein the articles within the first path are directed upwardly through an opening in the support surface and directly into the circular path.

6. The method of assembling a plurality of articles in a generally cylindrical, vertical stack by sequentially feeding articles to the bottom of the stack rotating upon a support surface comprising the steps of; advancing a plurality of random spaced articles along a first path at a predetermined speed, feeding each article from the first path to the upper surface of the support, continuously rotating each article directed to the support upper surface in a circular path about a vertical axis at a speed greater than the predetermined speed while elevating the articles within the circular path as additional articles are fed to the support upper surface.

7. The method of collecting a series of flexible fabric workpieces in a stable stack rotating about a vertical axis comprising the steps of; advancing a series of workpieces along a first path, directing each advancing workpiece upwardly to a second path while conveying the workpieces in the second path about the vertical axis to form a stack of at least partially overlapping workpieces which increases in height as additional workpieces are directed to the second path and beneath workpieces being conveyed in the second path.

8. The method of collecting a series of flexible fabric workpieces as recited in claim 7, wherein the workpieces advanced along the first path are randomly spaced and sequentially directed to the second path, and the workpieces in the second path are conveyed continuously until completion of the stack.

9. Apparatus for receiving and stacking a plurality of flexible or semi-rigid articles comprising: means for receiving and supporting thereon a plurality of articles, drive means for continuously slidably displacing all articles upon and relative to said receiving and supporting means in a generally circular path about a vertical axis, and means for continuously feeding articles to said receiving and supporting means.

10. Apparatus as recited in claim 9, wherein said feeding means is positioned below said receiving and supporting means and said receiving and supporting means defines an opening for receiving upwardly therethrough articles from said feeding means.

11. Apparatus as recited in claim 10, wherein said feeding means includes a conveyer, and said opening defines an elongated slot extending across said conveyor at an angle with respect to the direction of movement of articles upon said conveyer.

12. Apparatus as recited in claim 10, wherein said receiving and supporting means includes a ramp within said opening for guiding articles from said feeding means to said circular path.

13. Apparatus as recited in claim 9, wherein said receiving and supporting means includes a stationary member having an upper surface for slidably supporting articles traveling in said circular path, and also defines an opening for receiving therethrough articles advanced by said feeding means.

14. Apparatus as recited in claim 13, said drive means for slidably displacing the articles in said circular path including a vertically displaceable rotor for frictionally engaging the uppermost articles stacked upon said stationary member and rotating all articles upon said stationary member in the circular path.

15. Apparatus as recited in claim 14, wherein said rotor is provided with a friction material for engaging and pulling the articles to said circular path, and wherein the articles advanced through said opening and to said stationary member are positioned beneath the articles being displaced in said circular path on such stationary member.

16. Apparatus as recited in claim 15, wherein the articles upon said feeding means are randomly spaced, and wherein the articles spaced upon the stationary member are continuously rotated in said circular path.

17. Apparatus as recited in claim 14, wherein said rotor comprises a segmented disk, and means mounting said segments for displacement relative to each other, and with each segment being provided with article engaging frictional material.

18. An apparatus for stacking a plurality of flexible fabric workpieces in vertically aligned condition by directing the workpieces to the bottom of a stack comprising: a stationary workpiece support surface defining a workpiece receiving slot therein, means for feeding sequentially a plurality of random spaced workpieces along a first linear path, means for guiding the workpieces from the linear path, through the opening, and upon said support surface, and driven rotor means for slidably displacing in a circular path, workpieces advanced through said opening and to said support surface, and spindle means coupled to said rotor means for positively driving said rotor means while permitting said rotor means to be elevated as workpieces build upon said support surface underneath said rotor means to form the stack.

19. Apparatus for stacking flexible or semi-rigid articles vertically by directing articles to the bottom of the stack comprising: a stationary article support plate defining an opening therethrough, article conveyor means having at least a portion located below said plate for directing articles to said opening, guide means within said opening for directing articles from the conveyer means through said opening and to the article support plate, a driven spindle assembly, a vertically displaceable rotor means driven from said spindle assembly and positioned above said support plate and pivotably, releaseably coupled to said spindle assembly, said rotor means including a friction surface for engaging at least the articles initially directed through said opening and for slidably displacing all articles displaced through said opening in a circular path upon said support plate.

* * * * *